US009508299B2

(12) United States Patent
Lee et al.

(10) Patent No.: US 9,508,299 B2
(45) Date of Patent: Nov. 29, 2016

(54) METHOD OF DRIVING A DISPLAY PANEL AND A DISPLAY APPARATUS PERFORMING THE METHOD

(71) Applicant: SAMSUNG DISPLAY CO., LTD., Yongin, Gyeonggi-Do (KR)

(72) Inventors: Seung-Kyu Lee, Cheonan-si (KR); Youn-Hak Jeong, Cheonan-si (KR); Jang-Bog Ju, Seongnam-si (KR); Pil-Gyu Kang, Yongin-si (KR); Se-Jin Kim, Cheonan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 88 days.

(21) Appl. No.: 14/328,223

(22) Filed: Jul. 10, 2014

(65) Prior Publication Data

US 2015/0228238 A1 Aug. 13, 2015

(30) Foreign Application Priority Data

Feb. 10, 2014 (KR) ..... 10-2014-0014752

(51) Int. Cl.
*G09G 3/36* (2006.01)

(52) U.S. Cl.
CPC ..... *G09G 3/3648* (2013.01); *G09G 3/3614* (2013.01); *G09G 3/3696* (2013.01); *G09G 2300/0426* (2013.01); *G09G 2300/0447* (2013.01); *G09G 2300/0819* (2013.01); *G09G 2300/0842* (2013.01); *G09G 2310/0251* (2013.01); *G09G 2320/0209* (2013.01)

(58) Field of Classification Search
None
See application file for complete search history.

(56) References Cited

U.S. PATENT DOCUMENTS

| | | | | |
|---|---|---|---|---|
| 6,614,416 | B1 | 9/2003 | Yamamoto et al. | |
| 7,138,853 | B2 | 11/2006 | Kim et al. | |
| 7,619,603 | B2 | 11/2009 | Moon | |
| 7,902,910 | B2 * | 3/2011 | Park | G05F 1/563 327/536 |
| 8,022,916 | B2 | 9/2011 | Lee et al. | |
| 8,115,880 | B2 | 2/2012 | Hagino | |
| 8,514,162 | B2 | 8/2013 | Moh et al. | |
| 2013/0182018 | A1 * | 7/2013 | Jeong | G09G 3/3659 345/690 |

FOREIGN PATENT DOCUMENTS

| | | |
|---|---|---|
| KR | 1020050061800 | 6/2005 |
| KR | 1020070077348 | 7/2007 |
| KR | 1020080022719 | 3/2008 |
| KR | 1020130012985 | 2/2013 |

* cited by examiner

*Primary Examiner* — Kenneth B Lee, Jr.
(74) *Attorney, Agent, or Firm* — F. Chau & Associates, LLC

(57) ABSTRACT

A method of driving a display panel includes providing a boosting voltage line on the display panel with a boosting voltage, compensating the boosting voltage based on a feedback boosting voltage received from the display panel, and providing the boosting voltage line on the display panel with the compensated boosting voltage. The display panel includes a first sub pixel. The first sub pixel includes a first switching element and a first boosting switching element, the first switching element is connected to a first liquid crystal (LC) capacitor, a gate line, an m-th data line and a first electrode of the first LC capacitor, and the first boosting switching element is connected to the boosted voltage line, and 'm' is a natural number.

20 Claims, 5 Drawing Sheets

< NO APPLICATION OF VHB FEEDBACK >

< APPLICATION OF VHB FEEDBACK >

METHOD OF DRIVING A DISPLAY PANEL AND A DISPLAY APPARATUS PERFORMING THE METHOD

CROSS-REFERENCE TO RELATED APPLICATION

This application claims priority under 35 U.S.C. §119 to Korean Patent Application No. 10-2014-0014752 filed on Feb. 10, 2014, the disclosure of which is incorporated by reference herein in its entirety.

TECHNICAL FIELD

Exemplary embodiments of the present inventive concept relate to a method of driving a display panel and a display apparatus performing the method.

DISCUSSION OF THE RELATED ART

A liquid crystal display (LCD) panel may include a thin film transistor (TFT) substrate, an opposing substrate and an LC layer disposed between the two substrates. The TFT substrate may include a plurality of gate lines, a plurality of data lines crossing the gate lines, a plurality of TFTs connected to the gate lines and the data lines, and a plurality of pixel electrodes connected to the TFTs. A TFT may include a gate electrode extended from a gate line, a source electrode extended to a data line, and a drain electrode spaced apart from the source electrode.

The LCD panel may not emit light by itself. In other words, it is not self-emissive. The LCD panel may receive light from the backside of the LCD panel or from the front of the LCD panel. The LCD panel may have limited side visibility. To improve the side visibility, a multi-domain technique may be used. In the multi-domain technique, an area in which a pixel electrode is formed is divided into a plurality of domains, and LC molecules of the LC layer are arranged according to the domain in which they are located.

SUMMARY

According to an exemplary embodiment of the inventive concept, there is provided a method of driving a display panel which includes providing a boosting voltage line on the display panel with a boosting voltage, compensating the boosting voltage based on a feedback boosting voltage received from the display panel, and providing the boosting voltage line on the display panel with the compensated boosting voltage.

The display panel includes a first sub pixel. The first sub pixel includes a first switching element and a first boosting switching element, the first switching element is connected to a first liquid crystal (LC) capacitor, a gate line, an m-th data line and a first electrode of the first LC capacitor, and the first boosting switching element is connected to the boosted voltage line, and 'm' is a natural number.

In an exemplary embodiment of the inventive concept, the method may further include providing a second electrode of the first LC capacitor with a common voltage.

In an exemplary embodiment of the inventive concept, the boosting voltage may have a phase which swings between a first polarity and a second polarity opposite to the first polarity with respect to the common voltage by a frame period.

In an exemplary embodiment of the inventive concept, the method may further include generating the boosting voltage of the first polarity and the boosting voltage of the second polarity, wherein the display panel may include a first boosting voltage line configured to transfer the boosting voltage of the first polarity and a second boosting voltage line configured to transfer the boosting voltage of the second polarity.

In an exemplary embodiment of the inventive concept, the method may further include providing the first boosting voltage line with the boosting voltage of the first polarity and providing the m-th data line with a data voltage of the first polarity, wherein the display panel comprises a second sub pixel and the second sub pixel includes a second switching element connected to a second LC capacitor, the gate line, the m-th data line and a first electrode of the second LC capacitor.

In an exemplary embodiment of the inventive concept, the method may further include providing the second boosting voltage line with the boosting voltage of the second polarity and providing an (m+1)-th data line with a data voltage of the second polarity, wherein the display panel may further include a third sub pixel and a fourth sub pixel, the third sub pixel may include a third switching element and a second boosting switching element, the third switching element is connected to a third LC capacitor, the gate line, the (m+1)-th data line and a first electrode of the third LC capacitor, and the second boosting switching element is connected to the gate line, the first electrode of the third LC capacitor and the second boosting voltage line, and the fourth sub pixel may include a fourth switching element connected to a fourth LC capacitor, the gate line, the (m+1)-th data line and a first electrode of the fourth LC capacitor.

In an exemplary embodiment of the inventive concept, providing the boosting voltage line on the display panel with the compensated boosting voltage may include amplifying a difference between the boosting voltage and the feedback boosting voltage to compensate the boosting voltage applied to the boosting voltage line on the display panel.

According to an exemplary embodiment of the inventive concept, there is provided a display apparatus which includes: a diving voltage generator configured to generate a boosting voltage; a display panel which comprises a first sub pixel, the first sub pixel comprises a first switching element and a first boosting switching element, the first switching element is connected to a first LC capacitor, a gate line, an m-th data line and a first electrode of the first LC capacitor, and the first boosting switching element is connected to a boosting voltage line (wherein, m is a natural number); and a boosting compensator configured to compensate the boosting voltage based on a feedback boosting voltage received from the display panel and to provide the boosting voltage line on the display panel with the compensated boosting voltage.

In an exemplary embodiment of the inventive concept, the display panel may further include a second sub pixel which comprises a second switching element connected to a second LC capacitor, the gate line, the m-th data line and a first electrode of the second LC capacitor.

In an exemplary embodiment of the inventive concept, the driving voltage generator may be configured to generate a common voltage to be applied to a second electrode of each of the first and second LC capacitors.

In an exemplary embodiment of the inventive concept, the boosting voltage may have a phase which swings between a first polarity and a second polarity opposite to the first polarity with respect to the common voltage by a frame period.

In an exemplary embodiment of the inventive concept, the driving voltage generator may be configured to generate the boosting voltage of the first polarity and the boosting voltage of the second polarity opposite to the first polarity with respect to the common voltage, and the display panel may include a first boosting voltage line to be applied with the boosting voltage of the first polarity and a second boosting voltage line to be applied with the boosting voltage of the second polarity.

In an exemplary embodiment of the inventive concept, the first boosting voltage line may receive the boosting voltage of the first polarity, and the m-th data line may receive a data voltage of the first polarity.

In an exemplary embodiment of the inventive concept, the display panel further may include a third sub pixel and a fourth sub pixel, the third sub pixel may include a third switching element and a second boosting switching element, the third switching element is connected to a third LC capacitor, the gate line, an (m+1)-th data line and a first electrode of the third LC capacitor, and the second boosting switching element is connected to the gate line, the first electrode of the third LC capacitor and the second boosting voltage line, and the fourth sub pixel may include a fourth switching element connected to a fourth LC capacitor, the gate line, the (m+1)-th data line and a first electrode of the fourth LC capacitor.

In an exemplary embodiment of the inventive concept, the second boosting voltage line may receive the boosting voltage of the second polarity, and the (m+1)-th data line may receive a data voltage of the second polarity.

In an exemplary embodiment of the inventive concept, the boosting compensator may include a first input terminal configured to receive the boosting voltage, a second input terminal configured to receive the feedback boosting voltage, a differential amplifier configured to amplify a difference between the boosting voltage and the feedback boosting voltage, and an output terminal configured to output a compensation boosting voltage outputted from the differential amplifier to the boosting voltage line.

In an exemplary embodiment of the inventive concept, the differential amplifier may include a first voltage terminal and a second voltage terminal, the first voltage terminal may receive a first source voltage greater than the boosting voltage of the first polarity, and the second voltage terminal may receive a second source voltage less than the boosting voltage of the second polarity.

According to an exemplary embodiment of the inventive concept, there is provided a display apparatus including: a display panel including a plurality of pixels and a plurality of boosting voltage lines; and a boosting compensator configured to compensate a boosting voltage to be applied to at least one of the boosting lines based on a feedback boosting voltage received from the display panel.

The boosting compensator may include a differential amplifier configured to receive the feedback boosting voltage from the display panel and the boosting voltage from a driving voltage generator, and output a compensated boosting voltage to the display panel, the compensating boosting voltage being based on a difference between the feedback boosting voltage received from the display panel and the boosting voltage received from the driving voltage generator.

At least one of the pixels may include a switching element and a boosting switching element, the switching element is connected to a gate line, a data line, and a liquid crystal capacitor, and the boosting switching element is connected to the gate line, the liquid crystal capacitor and the at least one boosting voltage line.

BRIEF DESCRIPTION OF THE DRAWINGS

The above and other features of the present inventive concept will become more apparent by describing in detail exemplary embodiments thereof with reference to the accompanying drawings, in which.

DETAILED DESCRIPTION OF THE EMBODIMENTS

Hereinafter, exemplary embodiments of the present inventive concept will be explained in detail with reference to the accompanying drawings.

Figure 1:
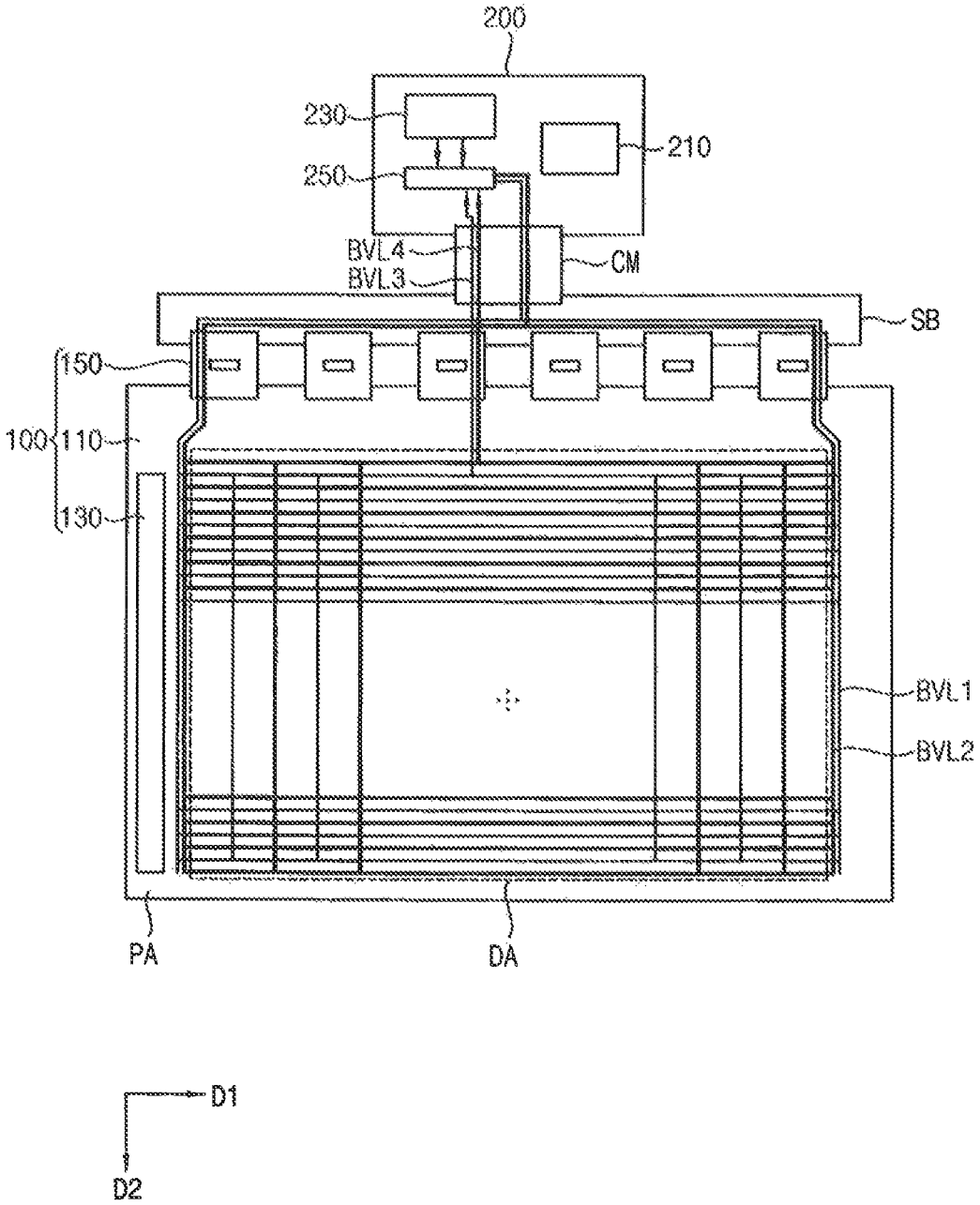
FIG. 1 is a block diagram illustrating a display apparatus according to an exemplary embodiment of the inventive concept.
Figure 2:
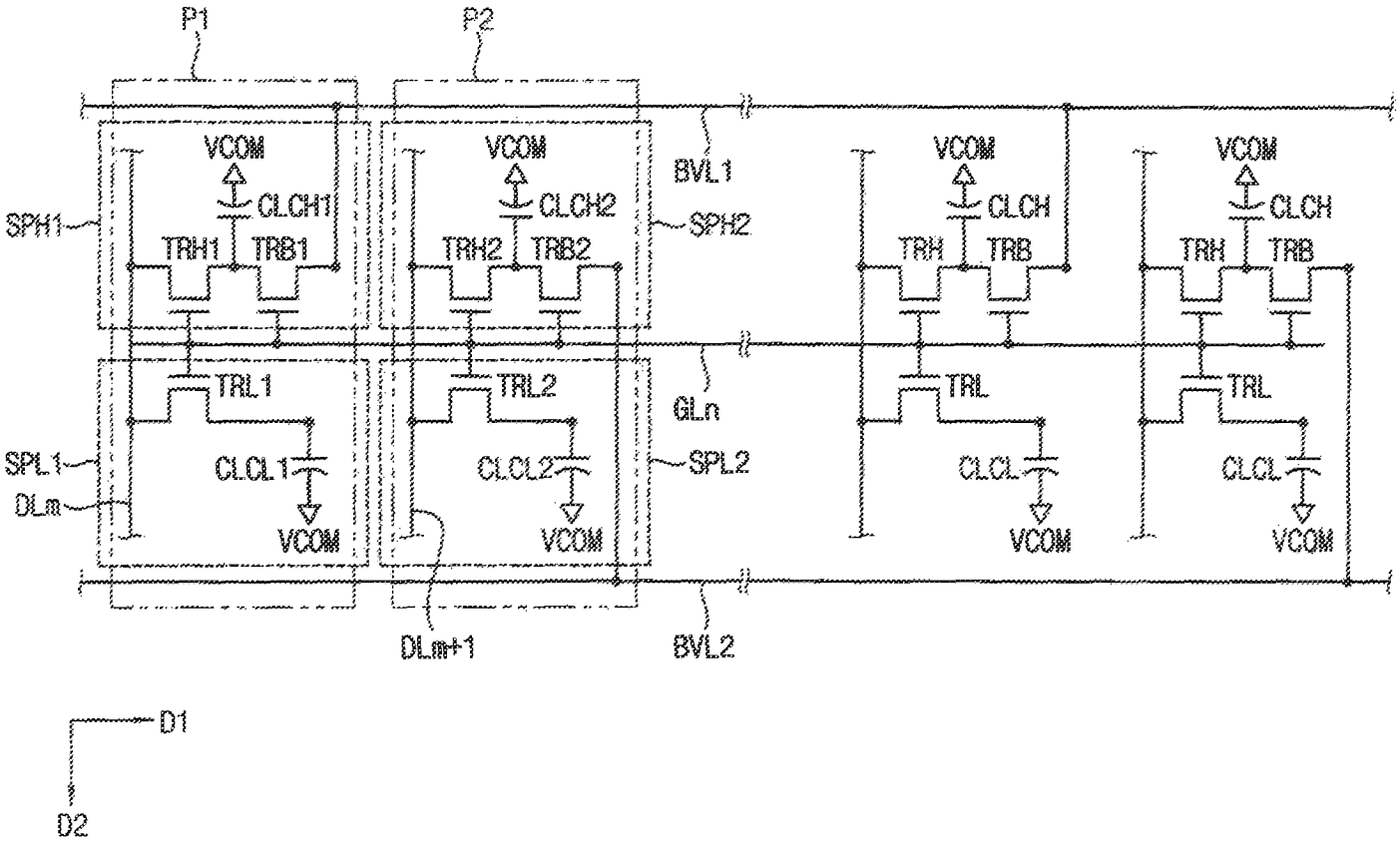
FIG. 2 is an equivalent circuit diagram illustrating a display panel of FIG. 1, according to an exemplary embodiment of the inventive concept.
Figure 3:
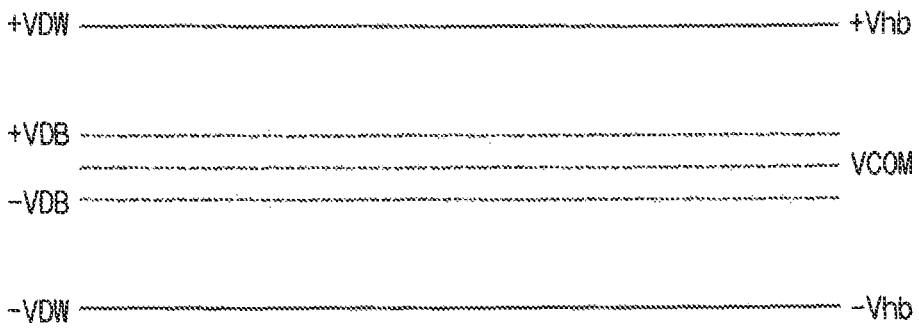
FIG. 3 is a waveform diagram illustrating a data voltage and a boosting voltage applied to the display panel of FIG. 1, according to an exemplary embodiment of the inventive concept.

FIG. 1 is a block diagram illustrating a display apparatus according to an exemplary embodiment of the inventive concept. FIG. 2 is an equivalent circuit diagram illustrating a display panel of FIG. 1, according to an exemplary embodiment of the inventive concept. FIG. 3 is a waveform diagram illustrating a data voltage and a boosting voltage applied to the display panel of FIG. 1, according to an exemplary embodiment of the inventive concept.

Referring to FIG. 1, the display apparatus may include a display module 100 and a driving module 200.

The display module 100 may include a display panel 110, a gate driver 130 and a data driver 150.

The display panel 110 may include a display area DA and a peripheral area PA surrounding the display area DA.

Referring to FIG. 2, a plurality of gate lines GLn (wherein, 'n' is a natural number), a plurality of data lines DLm and DLm+1 (wherein, 'm' is a natural number), a plurality of first boosting voltage lines BVL1, a plurality of second boosting voltage lines BVL2 and a plurality of pixels P are disposed in the display area DA.

The gate lines GLn extend in a first direction D1 and are arranged in a second direction D2 crossing the first direction D1.

The data lines DLm and DLm+1 extend in the second direction D2 and are arranged in the first direction D1.

The first boosting voltage lines BVL1 extend in the first direction D1 and are arranged in the second direction D2.

The second boosting voltage lines BVL2 extend in the first direction D1 and are arranged in the second direction D2.

The pixels P are arranged in a matrix which includes a plurality of pixel columns and a plurality of pixel rows.

The gate driver 130 is disposed in the peripheral area PA adjacent to an end portion of a gate line and is connected to the gate line. The gate driver 130 is configured to generate a gate signal and to sequentially provide the gate line with the gate signal. Alternatively, the gate driver 130 may be disposed in the peripheral area PA adjacent to both end portions of the gate line. In other words, at opposite ends of the gate line or gate lines. The gate driver 130 may be directly integrated in the peripheral area PA. Alternatively, the gate driver 130 may be mounted on the peripheral area PA as a tape carrier package (TCP).

The data driver 150 is disposed in the peripheral area PA adjacent to an end portion of a data line and is connected to the data line. The data driver 150 is configured to generate a data signal and to provide the data line with the data signal. The data driver 150 may be mounted on the peripheral area PA as the TCP.

The display module 100 may further include a source printed circuit board (PCB) SB and a connection member CM which connects the data driver 150 and the display panel 110.

The driving module 200 may include a timing controller 210, a driving voltage generator 230 and a boosting compensator 250 which are mounted on a PCB.

The timing controller 210 controls a driving timing of the display apparatus. For example, the timing controller 210 is configured to generate a plurality of timing control signals using a plurality of original control signals received from an external system to control the driving timing of the gate driver 130 and the data driver 150. In addition, the timing controller 210 is configured to correct original data received from the external system using various compensation algorithms and to provide the data driver 150 with data.

The driving voltage generator 230 is configured to generate a plurality of driving voltages which drives the display apparatus using a source voltage. For example, the driving voltage generator 230 is configured to generate a gate on voltage, a gate off voltage, a digital source voltage, an analog source voltage, a reference gamma voltage, a common voltage VCOM and so on. The gate on voltage and the gate off voltage are used to drive the gate line. The digital source voltage, the analog source voltage and the reference gamma voltage are used to drive the data line. The common voltage VCOM is used to drive the display panel 110.

In addition, in an exemplary embodiment of the inventive concept, the driving voltage generator 230 is configured to generate a boosting voltage of a first polarity and a boosting voltage of a second polarity. The boosting voltage of the first polarity is applied to a first boosting voltage line BVL1 and the boosting voltage of the second polarity is applied to a second boosting voltage line BVL2. The first polarity may be opposite to the second polarity with respect to the common voltage VCOM.

The boosting compensator 250 is configured to compensate the boosting voltage based on a feedback boosting voltage received from the display panel 110. The boosting compensator 250 is configured to receive the feedback boosting voltage of the first polarity and the feedback boosting voltage of the second polarity through a third boosting voltage line BVL3 and a fourth boosting voltage line BVL4.

For example, the boosting compensator 250 is configured to compensate the boosting voltage of the first polarity based on the feedback boosting voltage of the first polarity, and is configured to compensate the boosting voltage of the second polarity based on the feedback boosting voltage of the second polarity.

Referring to FIGS. 2 and 3, a method of driving the display panel 110 will now be explained.

The display panel 110 may include a first pixel P1 and a second pixel P2 which are connected to an n-th gate line GLn. Additional pixels may be included in the display panel 110 as shown by the pixels on the right-hand side of FIG. 2.

The first pixel P1 includes a first high sub pixel SPH1 and a first low sub pixel SPL1.

The first high sub pixel SPH1 includes a first high switching element TRH1, a first high liquid crystal (LC) capacitor CLCH1 and a first boosting switching element TRB1.

The first high switching element TRH1 is connected to the n-th gate line GLn, an m-th data line DLm and a first electrode of the first high LC capacitor CLCH1. A second electrode of the first high LC capacitor CLCH1 is configured to receive a common voltage VCOM.

The first boosting switching element TRB1 is connected to the n-th gate line GLn, the first electrode of the first high LC capacitor CLCH1 and the first boosting voltage line BVL1. The first boosting voltage line BVL1 transfers a boosting voltage +Vhb of a positive polarity which is the boosting voltage of the first polarity.

The first low sub pixel SPL1 includes a first low switching element TRL1 and a first low LC capacitor CLCL1.

The first low switching element TRL1 is connected to the n-th gate line GLn, the m-th data line DLm and a first electrode of the first low LC capacitor CLCL1. A second electrode of the first low LC capacitor CLCL1 is configured to receive the common voltage VCOM.

When the n-th gate line GLn receives a gate signal, the first high switching element TRH1, the first low switching element TRL1 and the first boosting switching element TRB1 are turned on.

Therefore, the first high LC capacitor CLCH1 and the first low LC capacitor CLCL1 charge an m-th data voltage transferred through the m-th data line DLm. The first high LC capacitor CLCH1 charges the boosting voltage +Vhb of the positive polarity transferred through the first boosting voltage line BVL1. The boosting voltage +Vhb has the same polarity as the m-th data voltage. The first high LC capacitor CLCH1 charges the m-th data voltage and the boosting voltage +Vhb of the positive polarity together.

Thus, there is a charging voltage difference between the first high LC capacitor CLCH1 and the first low LC capacitor CLCL1, and thus the first pixel P1 displays an image by using the first high sub pixel SPH1 and the first low sub pixel SPL1 having voltage-transmission curves different from each other. A visibility of the image displayed on the first pixel P1 may be improved.

The second pixel P2 includes a second high sub pixel SPH2 and a second low sub pixel SPL1.

The second high sub pixel SPH2 includes a second high switching element TRH2, a second high LC capacitor CLCH2 and a second boosting switching element TRB2.

The second high switching element TRH2 is connected to the n-th gate line GLn, an (m+1)-th data line DLm+1 and a first electrode of the second high LC capacitor CLCH2. A second electrode of the second high LC capacitor CLCH2 is configured to receive the common voltage VCOM.

The second boosting switching element TRB2 is connected to the n-th gate line GLn, the first electrode of the second high LC capacitor CLCH2 and the second boosting voltage line BVL2. The second boosting voltage line BVL2 transfers a boosting voltage −Vhb of a negative polarity which is the second polarity opposite to the first polarity with respect to the common voltage VCOM.

The second low sub pixel SPL2 includes a second low switching element TRL2 and a second low LC capacitor CLCL2.

The second low switching element TRL2 is connected to the n-th gate line GLn, the (m+1)-th data line DLm+1 and a first electrode of the second low LC capacitor CLCL2. A second electrode of the second low LC capacitor CLCL2 is configured to receive the common voltage VCOM.

When the n-th gate line GLn receives the gate signal, the second high switching element TRH2, the second low switching element TRL2 and the second boosting switching element TRB2 are turned on.

Therefore, the second high LC capacitor CLCH2 and the second low LC capacitor CLCL2 charge a (m+1)-th data voltage transferred though the (m+1)-th data line DLm+1. The second high LC capacitor CLCH2 charges the boosting voltage −Vhb of the negative polarity transferred through the second boosting voltage line BVL2. The boosting voltage −Vhb has the same polarity as the (m+1)-th data voltage. The second high LC capacitor CLCH2 charges the (m+1)-th data voltage and boosting voltage −Vhb of the negative polarity together.

Thus, there is a charging voltage difference between the second high LC capacitor CLCH2 and the second low LC capacitor CLCL2, and thus the second pixel P2 displays an image by using the second high sub pixel SPH2 and the second low sub pixel SPL2 having voltage-transmission curves different from each other. A visibility of the image displayed on the second pixel P2 may be improved.

Each of the boosting voltages applied to the first and second boosting voltage lines BVL1 and BVL2 has a phase which swings between the positive polarity and the negative polarity by a frame period.

For example, during a K-th frame (wherein, 'K' is a natural number), the first boosting voltage line BVL1 transfers the boosting voltage +Vhb of the positive polarity, and the second boosting voltage line BVL2 transfers the boosting voltage −Vhb of the negative polarity. Then, during an (K+1)-th frame, the first boosting voltage line BVL1 transfers the boosting voltage −Vhb of the negative polarity and the second boosting voltage line BVL2 transfers the boosting voltage +Vhb of the positive polarity.

In addition, during the K-th frame, the m-th data line DLm transfers the data voltage of the positive polarity which is a data voltage of the positive polarity corresponding to a predetermined grayscale of a black data voltage +VDB to a white data voltage +VDW, and the (m+1)-th data line DLm+1 transfers the data voltage of the negative polarity which is a data voltage of the negative polarity corresponding to a predetermined grayscale of a black data voltage −VDB to a white data voltage −VDW. Then, during the (K+1)-th frame, the m-th data line DLm transfers the data voltage of the negative polarity which is a data voltage of the negative polarity corresponding to a predetermined grayscale of the black data voltage −VDB to the white data voltage −VDW, and the (m+1)-th data line DLm+1 transfers the data voltage of the positive polarity which is a data voltage of the positive polarity corresponding to a predetermined grayscale of the black data voltage +VDB to the white data voltage +VDW.

Figure 4:
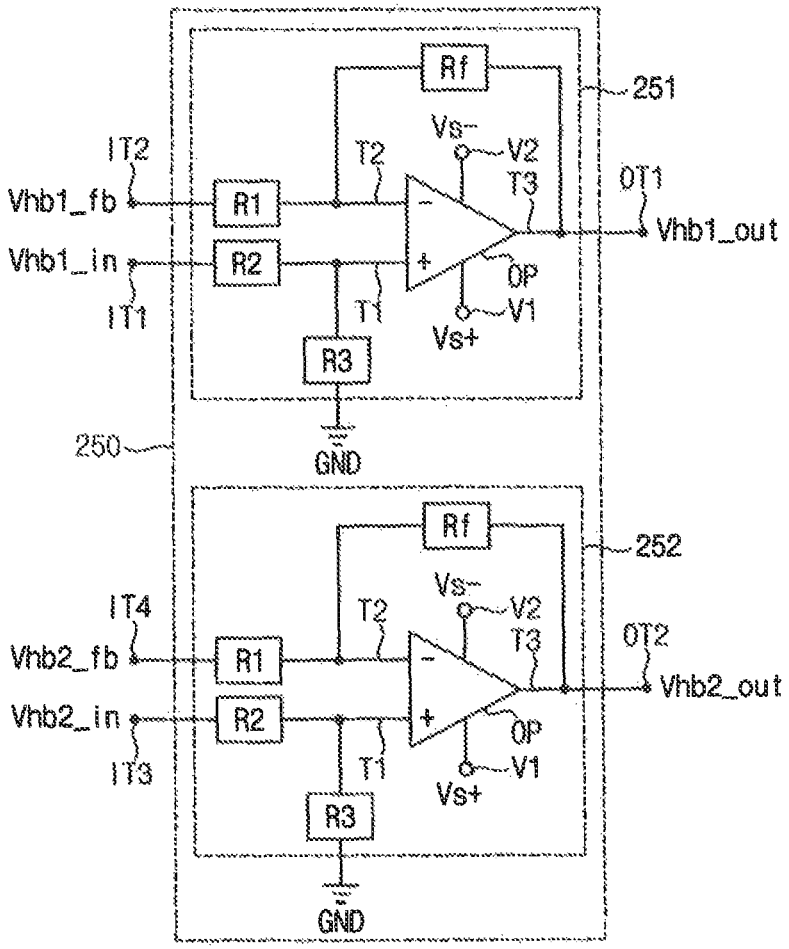
FIG. 4 is a circuit diagram illustrating a boosting compensator of FIG. 1, according to an exemplary embodiment of the inventive concept.

FIG. 4 is a circuit diagram illustrating the boosting compensator 250 of FIG. 1, according to an exemplary embodiment of the inventive concept.

Referring to FIGS. 1 and 4, the boosting compensator 250 may include a first voltage compensator 251 and a second voltage compensator 252.

The first voltage compensator 251 includes a first input terminal IT1, a second input terminal IT2 and a first output terminal OT1. The first input terminal IT1 receives a boosting voltage Vhb1_in of the first polarity from the driving voltage generator 230. The second input terminal IT2 receives a feedback boosting voltage Vhb1_fb of the first polarity from the display panel 110. The first output terminal OT1 outputs a compensation boosting voltage Vhb1_out of the first polarity. The compensation boosting voltage Vhb1_out of the first polarity is compensated from a difference between the boosting voltage Vhb1_in of the first polarity and the feedback boosting voltage Vhb1_fb of the first polarity.

The second input terminal IT2 is connected to the third boosting voltage line BVL3 and the first output terminal OT1 is connected to the first boosting voltage line BVL1, as shown in FIG. 1. The first polarity may be the positive polarity (+) or the negative polarity (−).

For example, the first voltage compensator 251 may include a differential amplifier OP, a first resistor element R1, a second resistor element R2, a third resistor element R3 and a feedback resistor element Rf.

The differential amplifier OP includes a first terminal T1 which receives a reference signal, a second terminal T2 which receives a comparison signal, a third terminal T3 which outputs a differential amplifying signal, a first voltage terminal V1 which receives a positive source voltage Vs+ and a second voltage terminal V2 which receives a negative source voltage Vs−. The first resistor element R1 is connected between the second input terminal IT2 and the second terminal T2. The second resistor element R2 is connected between the first input terminal IT1 and the first terminal T1. The third resistor element R3 is connected between the first terminal T1 and a ground GND. The feedback resistor element Rf is connected between the second terminal T2 and the third terminal T3.

The second voltage compensator 252 includes a third input terminal IT3, a fourth input terminal IT4 and a second output terminal OT2. The third input terminal IT3 receives a boosting voltage Vhb2_in of the second polarity from the driving voltage generator 230. The fourth input terminal IT4 receives a feedback boosting voltage Vhb2_fb of the second polarity from the display panel 110. The second output terminal OT2 outputs a compensation boosting voltage Vhb2_out of the second polarity. The compensation boosting voltage Vhb2_out of the second polarity is compensated from a difference between the boosting voltage Vhb2_in of the second polarity and the feedback boosting voltage Vhb2_fb of the second polarity.

The fourth input terminal IT4 is connected to the fourth boosting voltage line BVL4 and the second output terminal OT2 is connected to the second boosting voltage line BVL2, as shown in FIG. 1. The second polarity may be the positive polarity (+) or the negative polarity (−).

For example, the second voltage compensator 252 may include a differential amplifier OP, a first resistor element R1, a second resistor element R2, a third resistor element R3 and a feedback resistor element Rf.

The differential amplifier OP includes a first terminal T1 which receives a reference signal, a second terminal T2 which receives a comparison signal, a third terminal T3 which outputs a differential amplifying signal, a first voltage terminal V1 which receives a positive source voltage VS+ and a second voltage terminal V2 which receives a negative source voltage VS−. The first resistor element R1 is connected between the fourth input terminal IT4 and the second terminal 12. The second resistor element R2 is connected between the third input terminal IT3 and the first terminal T1. The third resistor element R3 is connected between the first terminal T1 and a ground GND. The feedback resistor element Rf is connected between the second terminal T12 and the third terminal T3.

The positive source voltage Vs+ applied to the first voltage terminal V1 may have a level higher than the boosting voltage of the positive polarity. For example, the positive source voltage Vs+ may be more than 2V higher than the boosting voltage of the positive polarity. In addition, the negative source voltage Vs− applied to the second voltage terminal V2 may have a level lower than the boosting voltage of the negative polarity. For example, the negative source voltage Vs− may be less than 1V lower than the boosting voltage of the negative polarity. The differential amplifier OP of the first and second voltage compensators 251 and 252 outputs the compensation boosting voltage Vhb_out which may be represented by the following Equation 1, $$Vhb_{out} = -\left(\frac{Rf}{R1}\right)\text{Vhb_fb} + \left(1 + \frac{Rf}{R1}\right) \times \left(\frac{R3}{R2 + R3}\right)\text{Vhb_in} \quad \text{< Equation 1 >}$$

The boosting compensator 250 compensates the boosting voltage applied to the display panel 110 based on the feedback boosting voltage received from the display panel 110 in real time. Thus, the boosting voltage, which is changed by the data voltage applied to the display panel 110, may be compensated in real time, and thus, the boosting voltage applied to the display panel 100 may be maintained at a predetermined level without regard to the data voltage applied to the display panel 110. Therefore, a display defect, such as a horizontal crosstalk caused by a voltage variation of the boosting voltage, may be prevented.

Figure 5A:
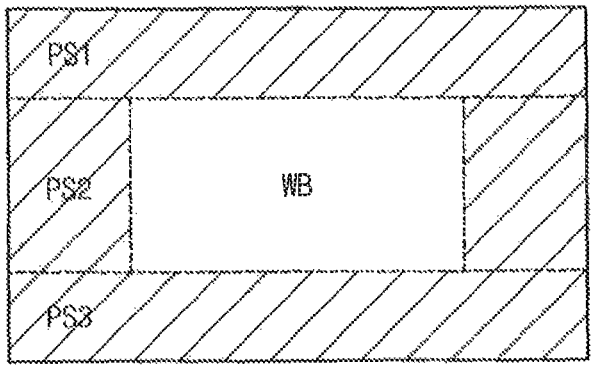
FIGS. 5A to 5C are diagrams for describing a method of compensating a boosting voltage in the display apparatus of FIG. 1, according to an exemplary embodiment of the inventive concept.
Figure 5B:
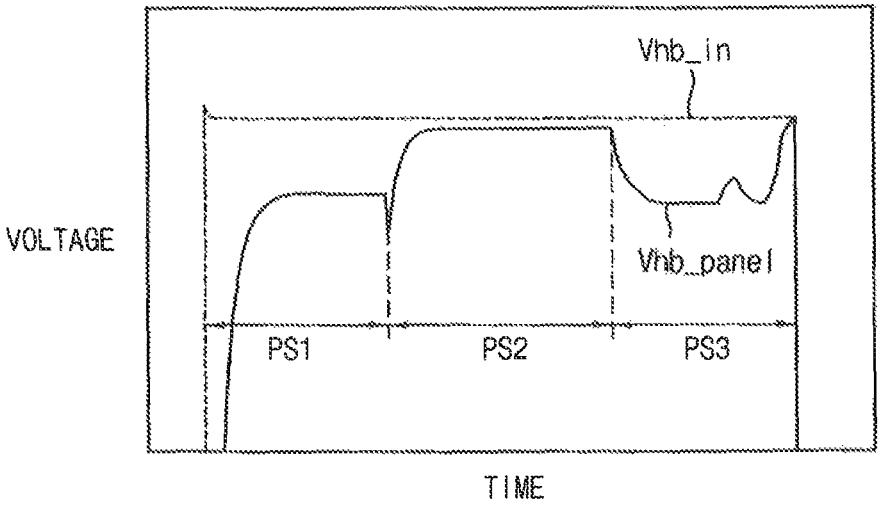

FIGS. 5A and 5B are diagrams for describing a method of compensating a boosting voltage in the display apparatus of FIG. 1, according to an exemplary embodiment of the inventive concept.

As shown in FIG. 5A, the display panel 110 displays a pattern image which includes a white image WB of a box shape.

For example, the display panel 110 is divided into a first area PS1, a second area PS2 and a third area PS3 in a vertical direction based on of a position the white image WB displayed thereon.

The first area PS1 displays a black image. The second area PS2 includes a central portion displaying the white image WB and a left-right side portion displaying the black image. The third area PS3 displays the black image.

The driving voltage generator 230 provides the display panel 110 with the boosting voltage of the positive polarity. For example, the common voltage may be about 8V, the boosting voltage of the positive polarity may be about 17V, the boosting voltage of the negative polarity may be about 1V, a white voltage of the positive polarity may be about 17V and a black voltage of the positive polarity may be about 10V.

Pixels in the first and third areas PS1 and PS3 receive the black voltage (about 10V) of the positive polarity and the boosting voltage (about 17V) of the positive polarity. A voltage difference between both electrodes of the first high LC capacitors CLCH1 disposed in the first and third areas PS1 and PS3 is about 7V.

According to a characteristic of a voltage which discharges from a high level to a low level, a level of the boosting voltage of the first and third areas PS1 and PS3 which display only the black image is lower than an original level of the boosting voltage generated from the driving voltage generator 230.

However, a level of the boosting voltage of the second area PS2, which partially displays the white image WB is approximate to the original level of the boosting voltage.

Pixels disposed in the central portion of the second area PS2 where the white image WB is displayed receive the white voltage (about 17V) of the positive polarity and the boosting voltage (about 17V) of the positive polarity. A voltage difference between both electrodes of the first high LC capacitors CLCH1 in the central portion of the second area PS2 is substantially equal to zero.

Therefore, the level of the boosting voltage in the second area PS2 may be similar to the original level of the boosting voltage generated from the driving voltage generator 230.

As described above, the voltage variation of the boosting voltage may be generated based on the position of the white image WB, and thus the voltage variation of the boosting voltage may cause a charging ratio difference between the pixels. Therefore, the display defect such as the horizontal crosstalk due to the charging ratio difference may occur.

FIG. 5B is a waveform diagram illustrating levels of the boosting voltages measured in the first, second and third areas PS1, PS2 and PS3 according to a comparative embodiment. A display apparatus according to the comparative embodiment omits the boosting compensator 250 described referring to FIGS. 1 to 4.

Referring to FIG. 5B, a panel level Vhb_panel of the boosting voltage measured in the first and third areas PS1 and PS3 which display only the black image is lower than the original level Vbh_in of the boosting voltage. However, a panel level Vhb_panel of the boosting voltage measured in the second area PS2 which partially displays the white image WB is similar to the original level Vbh_in of the boosting voltage.

Therefore, the display apparatus according to the comparative embodiment may have the display defect such as the horizontal crosstalk due to the charging ratio difference.

Figure 5C:
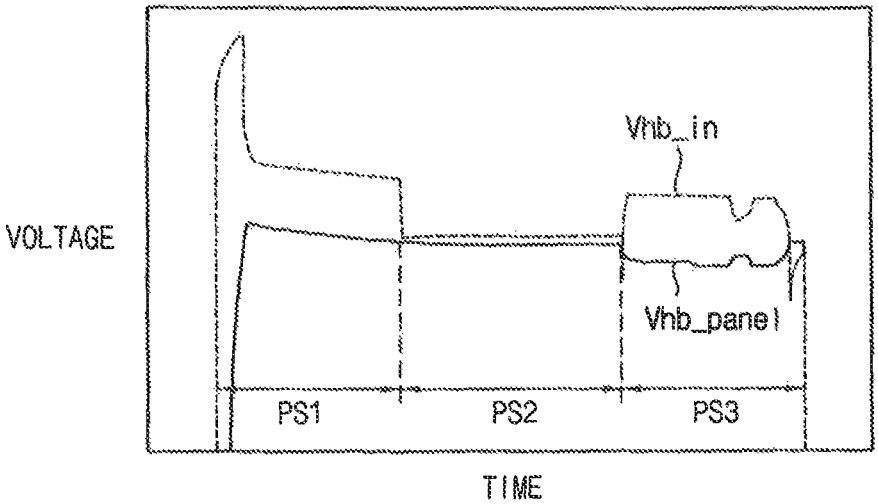

In contrast, FIG. 5C is a waveform diagram illustrating levels of the boosting voltages measured in the first, second and third areas PS1, PS2 and PS3 according to an exemplary embodiment of the inventive concept. A display apparatus according to the exemplary embodiment of the inventive concept includes the boosting compensator 250 described referring to FIGS. 1 to 4.

Referring to FIG. 5C, a panel level Vhb_panel of the boosting voltage measured in the first and third areas PS1 and PS3 which display only the black image is similar to a panel level Vhb_panel of the boosting voltage measured in the second area PS2 which partially displays the white image WB. In other words, the levels of the boosting voltage in the first, second and third areas PS1, PS2 and PS3 may be maintained at a predetermined level.

Therefore, the display apparatus according to the exemplary embodiment of the inventive concept compensates the boosting voltage applied to the display panel 110 based on the feedback boosting voltage received from the display panel 110 in real time, and thus the level of the boosting voltage applied to the display panel 110 may maintain a predetermined level. Therefore, the display defect such as the horizontal crosstalk due to the charging ratio difference may be prevented.

Table 1 illustrates measured values of the horizontal crosstalk based on resistance values of the resistor elements (R1-R3 and Rf) and a gain value of the differential amplifier (OP) as shown in FIG. 4.

TABLE 1

| R2 | R3 | R1 | RF | Gain | H-CT (%) | |
|---|---|---|---|---|---|---|
| 0 Ω | ∞ Ω | | | | 769.2 | CEx |
| | | 1K | 20K | 20 | 232.3 | EEx1 |
| | | 1K | 40K | 40 | 104.2 | EEx2 |

Referring to Table 1, according to the comparative embodiment (CEx), which omitted the boosting compensator 250, the horizontal crosstalk H_CT is about 769.2%. In contrast, according to an exemplary embodiment of the inventive concept 1 (EEx1), which includes the boosting compensator 250, the horizontal crosstalk H_CT is about 232.3%.

According to an exemplary embodiment of the inventive concept 2 (EEx2), which includes the boosting compensator 250 which has a resistance value and a gain value different from that of the exemplary embodiment 1, the horizontal crosstalk H_CT is about 104.2%.

The horizontal crosstalk H_CT of the exemplary embodiment 2 (EEx2) is about seven-times lower than the horizontal crosstalk H_CT of the comparative embodiment (CEx).

According to an exemplary embodiment of the inventive concept, the boosting compensator 250 compensates the boosting voltage applied to the display panel 110 based on the feedback boosting voltage received from the display panel 110 in real time, and thus the level of the boosting voltage applied to the display panel 110 may maintain a predetermined level. Therefore, the display defect such as the horizontal crosstalk due to the charging ratio difference may be prevented.

While the inventive concept has been particularly shown and described with reference to exemplary embodiments thereof, it will be understood by those of ordinary skill in the art that various changes in form and detail may be made therein without departing from the spirit and scope of the inventive concept as defined by the following claims.

What is claimed is:

1. A method of driving a display panel, comprising:

providing a boosting voltage from an output terminal of a boosting compensator to a boosting voltage line on the display panel;

compensating the boosting voltage based on a feedback boosting voltage received at an input terminal of the boosting compensator via a feedback boosting voltage line from the display panel, wherein the feedback boosting voltage line is separate from the boosting voltage line; and providing the compensated boosting voltage from the boosting compensator to the boosting voltage line on the display panel, wherein the display panel comprises a first sub pixel, the first sub pixel comprises a first switching element and a first boosting switching element, the first switching element is connected to a first liquid crystal (LC) capacitor, a gate line, an m-th data line and a first electrode of the first LC capacitor, and the first boosting switching element is connected to the boosted voltage line, wherein 'm' is a natural number.

2. The method of claim 1, further comprising:

providing a second electrode of the first LC capacitor with a common voltage.

3. The method of claim 2, wherein the boosting voltage has a phase which swings between a first polarity and a second polarity opposite to the first polarity with respect to the common voltage by a frame period.

4. The method of claim 3, further comprising:

generating the boosting voltage of the first polarity and the boosting voltage of the second polarity, wherein the display panel comprises a first boosting voltage line configured to transfer the boosting voltage of the first polarity and a second boosting voltage line configured to transfer the boosting voltage of the second polarity.

5. The method of claim 4, further comprising:

providing the first boosting voltage line with the boosting voltage of the first polarity; and providing the m-th data line with a data voltage of the first polarity, wherein the display panel comprises a second sub pixel and the second sub pixel comprises a second switching element connected to a second LC capacitor, the gate line, the m-th data line and a first electrode of the second LC capacitor.

6. The method of claim 5, further comprising:

providing the second boosting voltage line with the boosting voltage of the second polarity; and providing an (m+1)-th data line with a data voltage of the second polarity, wherein the display panel further comprises a third sub pixel and a fourth sub pixel, the third sub pixel comprises a third switching element and a second boosting switching element, the third switching element is connected to a third LC capacitor, the gate line, the (m+1)-th data line and a first electrode of the third LC capacitor, and the second boosting switching element is connected to the gate line, the first electrode of the third LC capacitor and the second boosting voltage line, and the fourth sub pixel comprises a fourth switching element connected to a fourth LC capacitor, the gate line, the (m+1)-th data line and a first electrode of the fourth LC capacitor.

7. The method of claim 1, wherein providing the boosting voltage line on the display panel with the compensated boosting voltage, comprises:

amplifying a difference between the boosting voltage and the feedback boosting voltage to compensate the boosting voltage applied to the boosting voltage line on the display panel.

8. A display apparatus, comprising:

a driving voltage generator configured to generate a boosting voltage;

a display panel which comprises a first sub pixel, the first sub pixel comprises a first switching element and a first boosting switching element, the first switching element is connected to a first liquid crystal (LC) capacitor, a gate line, an m-th data line and a first electrode of the first LC capacitor, and the first boosting switching element is connected to a boosting voltage line, wherein, 'm' is a natural number; and a boosting compensator configured to compensate the boosting voltage based on a feedback boosting voltage received from a feedback boosting voltage line of the display panel and to provide the boosting voltage line on the display panel with the compensated boosting voltage, wherein the feedback boosting voltage line is separate from the boosting voltage line.

9. The display apparatus of claim 8, wherein the display panel further comprises a second sub pixel which comprises a second switching element connected to a second LC capacitor, the gate line, the m-th data line and a first electrode of the second LC capacitor.

10. The display apparatus of claim 9, wherein the driving voltage generator is configured to generate a common voltage to be applied to a second electrode of each of the first and second LC capacitors.

11. The display apparatus of claim 10, wherein the boosting voltage has a phase which swings between a first polarity and a second polarity opposite to the first polarity with respect to the common voltage by a frame period.

12. The display apparatus of claim 11, wherein the driving voltage generator is configured to generate the boosting voltage of the first polarity and the boosting voltage of the second polarity opposite to the first polarity with respect to the common voltage, and the display panel comprises a first boosting voltage line to be applied with the boosting voltage of the first polarity and a second boosting voltage line to be applied with the boosting voltage of the second polarity.

13. The display apparatus of claim 12, wherein the first boosting voltage line receives the boosting voltage of the first polarity, and the m-th data line receives a data voltage of the first polarity.

14. The display apparatus of claim 12, wherein the display panel further comprises a third sub pixel and a fourth sub pixel, the third sub pixel comprises a third switching element and a second boosting switching element, the third switching element is connected to a third LC capacitor, the gate line, an (m+1)-th data line and a first electrode of the third LC capacitor, and the second boosting switching element is connected to the gate line, the first electrode of the third LC capacitor and the second boosting voltage line, and the fourth sub pixel comprises a fourth switching element connected to a fourth LC capacitor, the gate line, the (m+1)-th data line and a first electrode of the fourth LC capacitor.

15. The display apparatus of claim 14, wherein the second boosting voltage line receives the boosting voltage of the second polarity, and the (m+1)-th data line receives a data voltage of the second polarity.

16. The display apparatus of claim 12, wherein the boosting compensator comprises a first input terminal configured to receive the boosting voltage, a second input terminal configured to receive the feedback boosting voltage, a differential amplifier configured to amplify a difference between the boosting voltage and the feedback boosting voltage, and an output terminal configured to output a compensation boosting voltage outputted from the differential amplifier to the boosting voltage line.

17. The display apparatus of claim 16, wherein the differential amplifier comprises a first voltage terminal and a second voltage terminal, the first voltage terminal receives a first source voltage greater than the boosting voltage of the first polarity, and the second voltage terminal receives a second source voltage less than the boosting voltage of the second polarity.

18. A display apparatus, comprising:

a display panel including a plurality of pixels and a plurality of boosting voltage lines; and a boosting compensator configured to compensate a boosting voltage to be applied to at least one of the boosting lines based on a feedback boosting voltage received from the display panel, wherein the boosting compensator includes a differential amplifier configured to receive the feedback boosting voltage from a feedback boosting voltage line of the display panel and the boosting voltage from a driving voltage generator, and output a compensated boosting voltage to the display panel, the compensating boosting voltage being based on a difference between the feedback boosting voltage received from the display panel via the feedback boosting voltage line and the boosting voltage received from the driving voltage generator.

19. The display apparatus of claim 18, wherein at least one of the pixels includes a switching element and a boosting switching element, the switching element is connected to a gate line, a data line, and a liquid crystal capacitor, and the boosting switching element is connected to the gate line, the liquid crystal capacitor and the at least one boosting voltage line.

20. The method of claim 1, wherein the feedback boosting voltage line is not connected to the output terminal of the boosting compensator.

* * * * *